US011761407B1

(12) United States Patent
Merchant

(10) Patent No.: US 11,761,407 B1
(45) Date of Patent: Sep. 19, 2023

(54) INLET MIXER FOR EXHAUST GAS RECIRCULATION IN POWER GENERATION SYSTEMS

(71) Applicant: General Electric Company, Schenectady, NY (US)

(72) Inventor: Laxmikant Merchant, Karnataka (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 18/063,336

(22) Filed: Dec. 8, 2022

(51) Int. Cl.

| | |
|---|---|
| ***F02M 26/20*** | (2016.01) |
| ***F02M 26/19*** | (2016.01) |
| ***F02B 47/10*** | (2006.01) |
| ***F02M 26/35*** | (2016.01) |
| ***F02M 26/38*** | (2016.01) |

(52) U.S. Cl.
CPC ..... *F02M 26/20* (2016.02); *F02B 47/10* (2013.01); *F02M 26/19* (2016.02); *F02M 26/35* (2016.02); *F02M 26/38* (2016.02)

(58) Field of Classification Search
CPC ..... F02M 26/20; F02M 26/19; F02M 26/35; F02M 26/38; F02B 47/10
See application file for complete search history.

(56) References Cited

U.S. PATENT DOCUMENTS

| | | | | |
|---|---|---|---|---|
| 7,797,937 | B2 | 9/2010 | Endicott et al. | |
| 8,083,466 | B2 | 12/2011 | Zhang et al. | |
| 9,631,542 | B2 | 4/2017 | Subramaniyan et al. | |
| 9,926,891 | B2 | 3/2018 | Zurlo et al. | |
| 10,012,184 | B2 * | 7/2018 | Guidi | F02M 26/06 |
| 10,655,542 | B2 | 5/2020 | Rittenhouse et al. | |
| 11,300,043 | B2 * | 4/2022 | Bogner | F02M 26/21 |
| 2008/0127645 | A1 | 6/2008 | Easley et al. | |
| 2011/0138766 | A1 | 6/2011 | Elkady et al. | |
| 2012/0180478 | A1 * | 7/2012 | Johnson | F02D 9/02 123/568.11 |

FOREIGN PATENT DOCUMENTS

| | | | |
|---|---|---|---|
| EP | 2299121 | A2 | 3/2011 |
| WO | 2014009524 | A1 | 1/2014 |
| WO | 2018110207 | A1 | 6/2018 |

* cited by examiner

*Primary Examiner* — Xiao En Mo
(74) *Attorney, Agent, or Firm* — Armstrong Teasdale LLP

(57) ABSTRACT

An exhaust gas recirculation (EGR) mixer for use in a power generation system is provided. The EGR mixer includes a mixing chamber defining a flow direction and a working fluid inlet coupled with the mixing chamber for introducing a working fluid into the mixing chamber along the flow direction. The EGR mixer also includes exhaust gas injection ducts extending across the mixing chamber downstream from the working fluid inlet. Each of the exhaust gas injection ducts is oriented to receive exhaust gases being recirculated within the power generation system and to inject the exhaust gases into the mixing chamber in a direction that intersects the flow direction to generate a turbulent flow within the mixing chamber. The EGR mixer also includes an outlet coupled with the mixing chamber for directing a mixture of the exhaust gases and the working fluid to a compressor within the power generation system.

20 Claims, 6 Drawing Sheets

INLET MIXER FOR EXHAUST GAS RECIRCULATION IN POWER GENERATION SYSTEMS

BACKGROUND

The present disclosure relates generally to power generation systems and, more specifically, to systems that use recirculated exhaust gases to enhance plant output.

Gas turbine engines are widely used in industrial and power generation operations. A conventional gas turbine engine includes a compressor section, a combustor section downstream from the compressor section, and a turbine section downstream from the combustor section. A working fluid, such as ambient air, flows into the compressor section where it is compressed before passing into the combustor section. The compressed working fluid is mixed with a fuel and burned within the combustor section to generate combustion gases which expand through the turbine section to rotate a shaft producing electricity.

In at least some known gas turbine engines, the compressed working fluid contains an excess quantity of oxygen as compared to an amount of oxygen required to support combustion. As a result, temperatures within the combustor section may be elevated which may create various undesirable emissions, including, but not limited to, nitrous oxides (hereinafter $NO_x$). Accordingly, regulating the working temperatures of the gas turbine engine by reducing the available oxygen entering the combustion section may regulate working temperatures and thus reduce the production of $NO_x$.

Various methods are known in the art for reducing combustion temperatures and the production of $NO_x$ within the combustor section. For example, some gas turbine engines utilize an exhaust gas recirculation (EGR) system which captures at least a portion of the combustion exhaust gases exiting the turbine section. The combustion exhaust gases exiting the turbine section generally have a lower oxygen level as compared to the working fluid (e.g., ambient air) entering the compressor section. The EGR system mixes the exhaust gases with the working fluid and introduces the mixture into the compressor section. As a result, the high oxygen content of the working fluid entering the compressor is diluted with the lower oxygen content exhaust gases. The ratio of the working fluid to exhaust gases in the mixture entering the compressor section is also suitable to maintain sufficient oxygen in the compressed working fluid supplied to the combustor section in order to support combustion.

Typically, the EGR system includes an absorption chiller that reduces the temperature and moisture concentration in the recirculated exhaust gases prior to the exhaust gases mixing with the working fluid. However, the exhaust gases post-cooling may still have a higher temperature than the working fluid (e.g., ambient air) prior to mixing. Additionally, the exhaust gases may retain moisture after absorption. As a result, upon mixing with the cooler working fluid, moisture in the exhaust gases may condense. Operation of the compressor may be negatively impacted by condensation from the working fluid-exhaust gas mixture entering the compressor.

Additional problems associated with known exhaust gas recirculation systems may exist. For example, it may be challenging to mix large quantities of exhaust gases with the working fluid prior to the mixture entering the compressor section to reduce compressor distortion and/or surge. Mixers utilized to mix the exhaust gases and working fluid upstream from the compressor section may require a large footprint to provide adequate mixing. However, increasing the footprint of the mixer adds costs to the overall power generation system. Alternatively, mixing capability may be increased within a smaller footprint by supplying the exhaust gases at a higher pressure to induce turbulence in the mixer, but this requires higher blower costs in the EGR system upstream from mixer. Moreover, known EGR systems typically include filter media located downstream from the mixer to reduce and/or eliminate particulates and other contaminates that may be entrained within the working fluid-exhaust gas mixture. The filter media is typically downstream from the mixer so that the pressure of the working fluid is not decreased prior to mixing, thus enabling greater turbulence in the mixer. The filter media increases the pressure drop of the working fluid-exhaust gas mixture entering the compressor, and thus decreases the efficiency of the EGR system and/or compressor. The filter media, which may include filter papers made of cellulose, for example, may also become deteriorated and/or destroyed by the condensation introduced by the working fluid-exhaust gas mixture.

Accordingly, there exists a need for an EGR mixer for producing a working fluid-exhaust gas mixture supplied to a rotary machine that addresses the above-described problems and that facilitates adequate mixing of the working fluid and exhaust gas at lower pressures, reducing the footprint of the mixer, removing condensation within the working fluid-exhaust gas mixture, minimizing and/or eliminating pressure drop across the mixer, and/or minimizing damage to filter media.

BRIEF DESCRIPTION

In one aspect, an exhaust gas recirculation (EGR) mixer for use in a power generation system that includes an EGR system configured to recirculate exhaust gases generated within the power generation system is provided. The EGR mixer includes a mixing chamber defining a flow direction and a working fluid inlet coupled with the mixing chamber for introducing a working fluid into the mixing chamber along the flow direction. The EGR mixer also includes a plurality of exhaust gas injection ducts extending across the mixing chamber downstream from the working fluid inlet. Each of the plurality of exhaust gas injection ducts is oriented to receive the exhaust gases being recirculated and to inject the exhaust gases into the mixing chamber in a direction that intersects the flow direction to generate a turbulent flow within the mixing chamber. The EGR mixer also includes an outlet coupled with the mixing chamber downstream from the plurality of exhaust gas injection ducts for directing a mixture of the exhaust gases and the working fluid to a compressor within the power generation system.

In another aspect, a power generation system is provided. The power generation system includes a rotary machine and an exhaust gas recirculation (EGR) system. The rotary machine includes a compressor and a turbine coupled to the compressor and configured to produce exhaust gases. The EGR system is configured to recirculate the exhaust gases from the turbine towards the compressor, and the EGR system includes an EGR mixer for mixing the exhaust gases being recirculated and a working fluid. The EGR mixer includes a mixing chamber defining a flow direction and a working fluid inlet coupled with the mixing chamber for introducing the working fluid into the mixing chamber along the flow direction. The EGR mixer also includes a plurality of exhaust gas injection ducts extending across the mixing chamber downstream from the working fluid inlet. Each of the plurality of exhaust gas injection ducts is oriented to receive the exhaust gases being recirculated and to inject the exhaust gases into the mixing chamber in a direction that intersects the flow direction to generate a turbulent flow within the mixing chamber. The EGR mixer also includes an outlet coupled with the mixing chamber downstream from the plurality of exhaust gas injection ducts for directing a mixture of the exhaust gases and the working fluid to the compressor of the rotary machine.

In another aspect, a method of operating a power generation system is provided. The power generation system includes an exhaust gas recirculation (EGR) system including an EGR mixer. The EGR mixer includes a mixing chamber, a working fluid inlet coupled with the mixing chamber, a plurality of exhaust gas injection ducts extending across the mixing chamber downstream from the working fluid inlet, and an outlet coupled with the mixing chamber downstream from the plurality of exhaust gas injection ducts. The method includes generating exhaust gases within the power generation system and recirculating at least a portion of the exhaust gases towards a compressor within the power generation system. The method also includes introducing a working fluid into the mixing chamber of the EGR mixer along a flow direction via the working fluid inlet. The method also includes injecting the exhaust gases being recirculated into the mixing chamber of the EGR mixer via the plurality of exhaust gas injection ducts in a direction that intersects the working fluid to generate turbulent flow within the mixing chamber and to produce a mixture of the exhaust gases and the working fluid. The method also includes directing the mixture to the compressor via the outlet of the EGR mixer.

DETAILED DESCRIPTION

Figure 1:
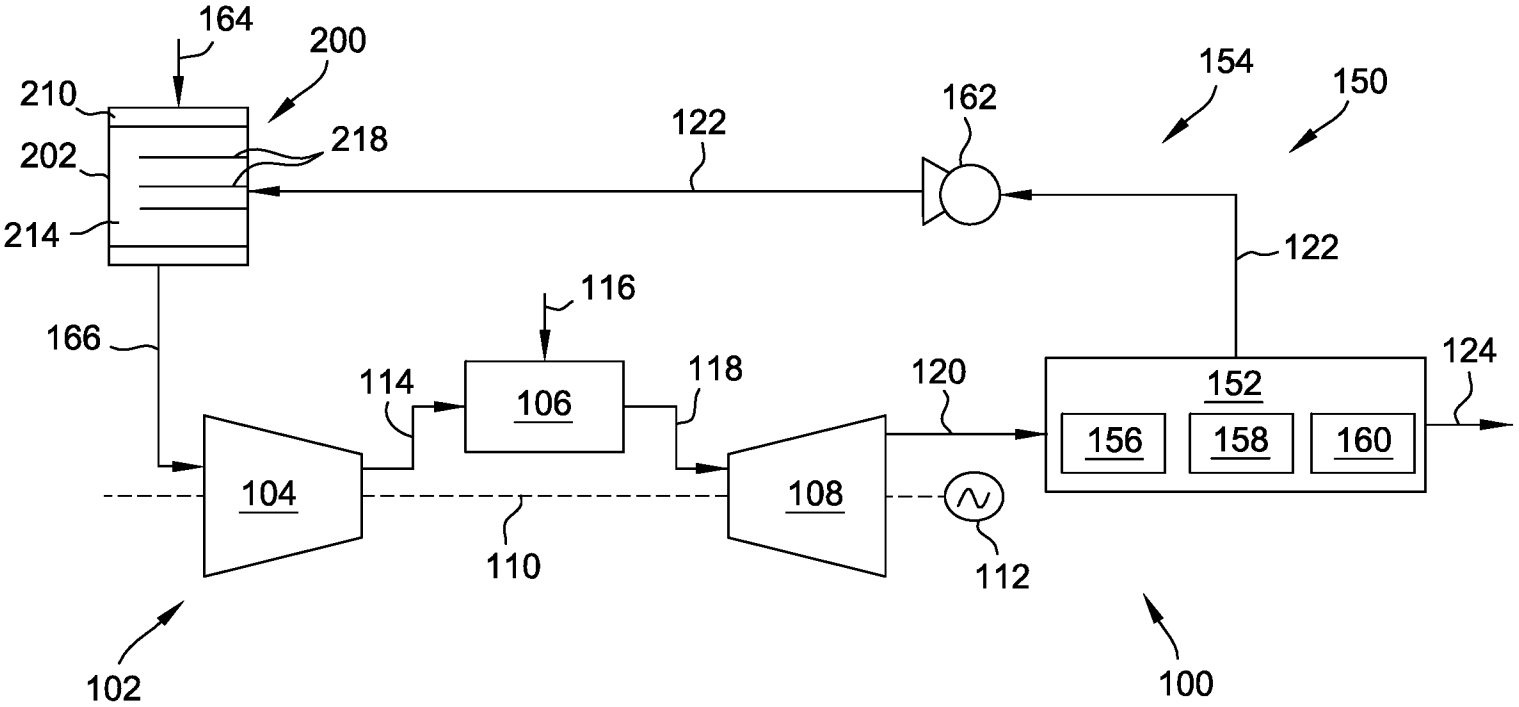
FIG. 1 is a schematic illustration of an exemplary power generation system including an exhaust gas recirculation system.
Figure 2:
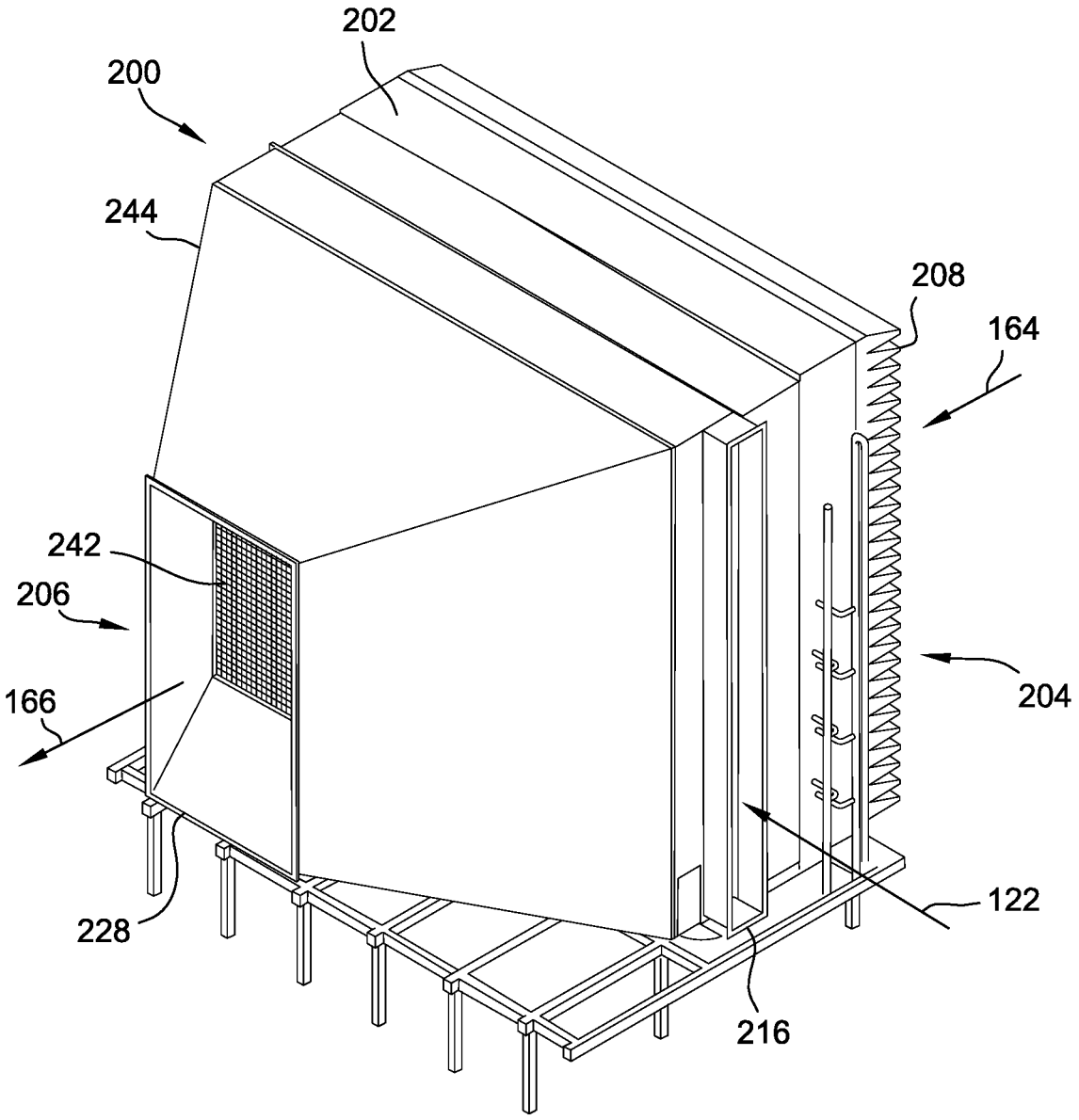
FIG. 2 is a perspective view of an exemplary exhaust gas recirculation mixer for mixing a working fluid with exhaust gas being recirculated in the power generation system shown in FIG. 1.
Figure 3:
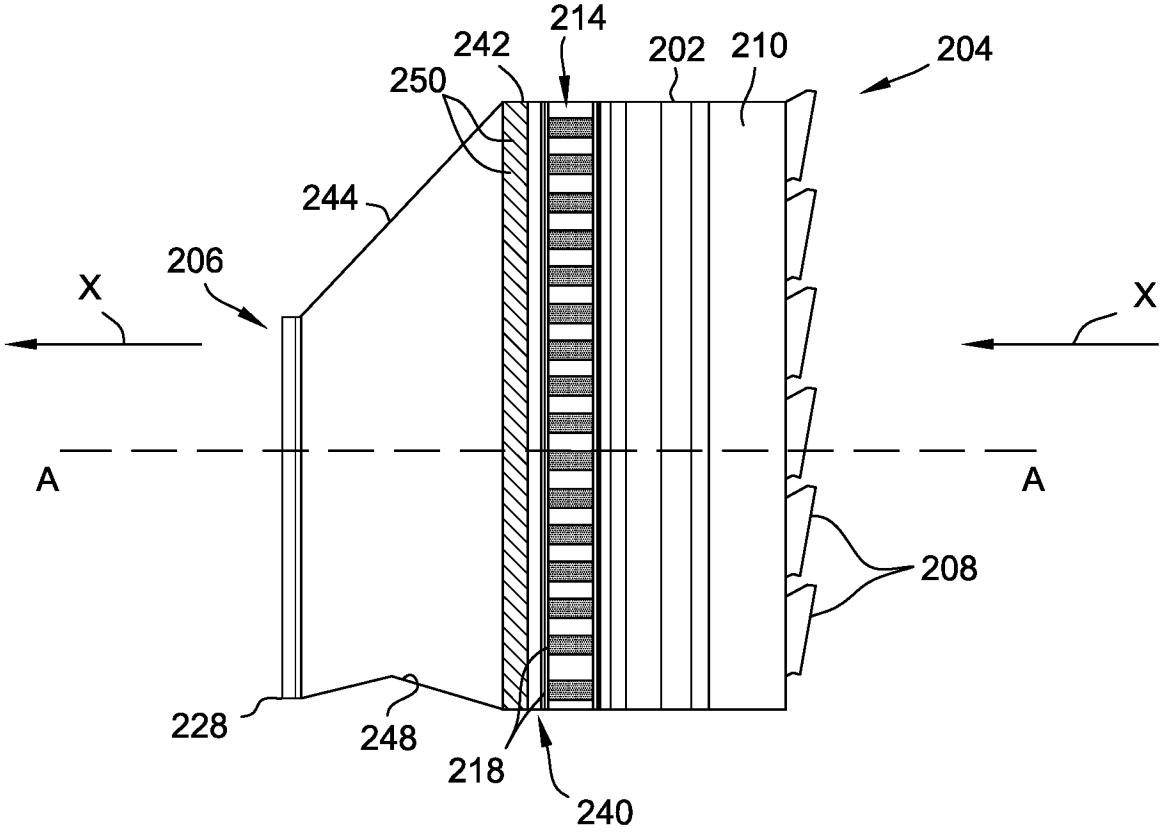
FIG. 3 is a cross-sectional side view of the exhaust gas recirculation mixer of FIG. 2.

The embodiments described herein relate to power generation systems that use recirculated exhaust gases to enhance plant output and/or efficiency. In particular, the disclosed embodiments relate to power generation systems that include an exhaust gas recirculation (EGR) system that recirculates exhaust gases produced by a turbine of a rotary machine (e.g., a gas turbine engine) to be mixed with a working fluid (e.g., ambient air) and that subsequently supplies the mixture to a compressor. The EGR system includes an EGR mixer upstream from the compressor that mixes the exhaust gases and the working fluid. The exhaust gases are recirculated and mixed with the working fluid prior to the mixture being introduced in the compressor. The mixture serves as a diluent for the oxygen in the compressed working fluid being channeled downstream to a combustion section downstream from the compressor. As a result, the peak firing temperature in the combustion section may be reduced and/or maintained below a threshold temperature, and/or exhaust emissions (e.g., NO emissions) generated are reduced and/or maintained below a threshold level.

The exemplary embodiments of EGR mixers described herein each include a mixing chamber, a working fluid inlet coupled with the mixing chamber, and an outlet coupled with the mixing chamber. Working fluid (e.g., ambient air) introduced into the mixing chamber via the working fluid inlet flows across the mixing chamber in a flow direction towards the outlet. Exemplary EGR mixer embodiments also include a plurality of exhaust gas injection ducts that extend across the mixing chamber downstream from the working fluid inlet.

The plurality of exhaust gas injection ducts each receive exhaust gases being recirculated from a turbine of a rotary machine (e.g., a gas turbine engine) and inject the exhaust gases into the mixing chamber in a direction that intersects the flow direction of the working fluid flowing across the mixing chamber. More specifically, the exhaust gases are injected by the exhaust gas injection ducts in cross-flow relation relative to the working fluid such that a turbulent flow is generated within the mixing chamber. The exhaust gas injection ducts may be oriented (e.g., in parallel succession, such as in a vertically-stacked orientation) in a direction substantially perpendicular to the flow direction, and each duct may include one or more of a series of holes (i.e., exhaust gas injection locations) that are spaced across a length of the respective exhaust gas injection duct. The holes formed in each exhaust gas injection duct may be shaped, sized, and positioned (e.g., spaced) at any shape, size, and/or relative position that facilitates substantially uniform mixing across a cross-sectional area of the mixing chamber.

Exemplary EGR mixer embodiments may also include one or more drain ports located below the mixing chamber and/or the outlet, and the exhaust gas injection ducts may be shaped to enable condensate produced during mixing to flow from the exhaust gas injection ducts towards the drain port(s). In some embodiments, the EGR mixer may include a moisture collector to extract condensate from the exhaust gas-working fluid mixture as the mixture exits the mixer, and the extracted condensate may be channeled to the drain port(s) via a condensate duct. In certain embodiments, filter media may be utilized to filter particulate from the working fluid, and in such embodiments, the filter media is suitably located in close proximity to the inlet and upstream from the mixing chamber. The mixture of the exhaust gases and the working fluid exits the EGR mixer via the outlet and is subsequently directed to the compressor.

The exemplary EGR mixer embodiments described herein facilitate increasing the efficiency of mixing of exhaust gas with working fluids, such as oxidant (e.g., ambient air), in an EGR system for a rotary machine. The EGR mixer generates turbulent flow by injecting the exhaust gas in cross-flow relation relative to the working fluid(s) flowing through the mixing chamber, thereby facilitating increasing the mixing capability of the mixer, and thus providing a uniform mixture of the exhaust gases and working fluid(s) across a cross-sectional area of the mixing chamber. As such, reductions in the distortion and/or surge of the compressor are facilitated. The EGR mixer may suitably enable mixing large quantities of exhaust gases and working fluid(s) at lower pressures, thus facilitating reducing energy output in supplying the exhaust gases and/or working fluid(s) to the mixing chamber. The EGR mixer may also facilitate removal or extraction of condensate produced by mixing hot, saturated exhaust gases with a cooler working fluid prior to flowing the exhaust gas/working fluid mixture through the compressor, thereby reducing the risk of damage from water impingement in the compressor (e.g., on the compressor blades). Suitably, the mixing chamber of the EGR mixer is downstream from filter media utilized to filter particulate from the working fluid prior to mixing, thus facilitating reducing or eliminating damage to or deterioration of the filter media caused by condensate within the exhaust gas/working fluid mixture and reducing a pressure drop across the EGR mixer.

When introducing elements of various embodiments disclosed herein, the articles "a," "an," "the," and "said" are intended to mean that there are one or more of the elements. The terms "comprising," "including," and "having" are intended to be inclusive and mean that there may be additional elements other than the listed elements.

Unless otherwise indicated, approximating language, such as "generally," "substantially," and "about," as used herein indicates that the term so modified may apply to only an approximate degree, as would be recognized by one of ordinary skill in the art, rather than to an absolute or perfect degree. Accordingly, a value modified by a term or terms such as "about," "approximately," and "substantially" is not to be limited to the precise value specified. In at least some instances, the approximating language may correspond to the precision of an instrument for measuring the value. Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item.

FIG. 1 is a schematic illustration of an exemplary power generation system 100. In the exemplary embodiment, the power generation system 100 includes a rotary machine 102. In the exemplary embodiment, rotary machine 102 is a gas turbine engine 102. The gas turbine engine 102 includes a compressor 104, one or more combustors 106, and a turbine 108 coupled together in a serial flow relationship. A shaft 110 extends axially and operatively couples the compressor 104 to the turbine 108. The gas turbine engine 102 may be coupled to a generator 112 via shaft 110 to produce electrical power.

The power generation system 100 also includes an exhaust gas recirculation (EGR) system 150 downstream from and fluidly coupled to the gas turbine engine 102. The EGR system 150 includes an exhaust gas treatment system 152 that receives exhaust gases 120 produced by the gas turbine engine 102 through a conduit and channels treated exhaust gases 122 through an EGR loop 154 that is recirculated back toward compressor 104, described in further detail below. A portion of treated exhaust gases 124 may also be discharged from the exhaust gas treatment system 152 into the atmosphere through an exhaust outlet. In certain embodiments, the exhaust gas treatment system 152 may include a plurality of treatment units for use in producing treated exhaust gases 122 and 124, such as a filter unit 156, a selective catalytic reduction unit 158, an absorption unit 160, and/or any other type of exhaust gas treatment unit. The treated exhaust gases 122 and 124 may have a lower temperature and/or lower saturation (e.g., moisture content) than a temperature and/or saturation of the exhaust gases 120 exiting the gas turbine engine 102.

In some embodiments, the power generation system 100 may be a combined cycle power plant that includes the gas turbine engine 102 and a steam cycle arrangement including a heat recovery steam generator (HRSG) (not shown) and a steam turbine engine (not shown). The HRSG receives exhaust gases 120 from the gas turbine engine 102, extracts heat from the exhaust gases 120 and discharges exhaust gases at a lower temperature than an operating temperature of the exhaust gases 120 exiting the gas turbine engine 102. The HRSG also discharges steam that is channeled towards the steam turbine engine, to enable the steam to perform work within the steam turbine engine. The gas turbine engine 102 and the steam turbine engine may both be operatively coupled to the generator 112 that produces electrical power using working fluids flowing through each engine.

The treated exhaust gases 122 are recirculated from the exhaust gas treatment system 152 through the EGR loop 154 and are routed to an EGR mixer 200 upstream from the compressor 104. In certain embodiments, the EGR mixer 200 may receive the treated exhaust gases 122, untreated exhaust gases 120 from the gas turbine engine 102, or any other source of exhaust gas with or without passing through various equipment. For example, in some embodiments, exhaust gases 120 from the gas turbine engine 102 may be recirculated to the EGR mixer 200 through the EGR loop 154 without flowing through the exhaust gas treatment system 152. In the exemplary embodiment, the EGR system 150 includes a recirculation blower or compressor 162 coupled within the EGR loop 154 between the exhaust gas treatment system 152 and the EGR mixer 200. The blower 162 receives the exhaust gases 122 and discharges the exhaust gases 122, which may be compressed at this stage, towards the EGR mixer 200. In certain embodiments, the EGR system 150 may include a control valve or other control equipment (e.g., a splitter, not shown in FIG. 1) in the EGR loop 154 to facilitate controlling the quantity of the exhaust gases 122 being recirculated to the EGR mixer 200. For example, the EGR system 150 may recirculate from between about 0% to about 40% of the exhaust gases 120 exiting the gas turbine engine 102 through the EGR loop 154 to the EGR mixer 200, and the remainder of the exhaust gases 120 are discharged as treated exhaust gases 124, or are discharged prior to the gases being channeled to the exhaust gas treatment system 152.

During operating, the combustor 106 receives a compressed working fluid 114, including an oxidant (e.g., compressed air) from the compressor 104 and fuel 116 supplied from a fuel supply (not shown). The fuel 116 and the compressed working fluid 114 are mixed and combusted in the combustor 106 to generate combustion gases 118. The combustion gases 118 are channeled through the turbine 108, in which the combustion gases 118 expand and perform work in the turbine 108, causing the shaft 110 to rotate and thus enable the generator 112 to produce electrical power. The exhaust gases 120 are discharged from the gas turbine engine 102 after performing work in the turbine 108 and are received by the exhaust gas treatment system 152. The treated exhaust gases 122 are recirculated through the EGR loop 154 via blower 162 to the EGR mixer 200, where the exhaust gases 122 are mixed with a working fluid 164, such as ambient air. A mixture 166 of the exhaust gases 122 and the working fluid 164 exiting the EGR mixer 200 is channeled to the compressor 104, wherein the mixture 166 is compressed and is channeled to the combustor 106 as the compressed working fluid 114. Mixing the working fluid 164 with the recirculated exhaust gases 122 to produce the mixture 166 may dilute the working fluid 164 to reduce the amount of oxygen entrained in the compressed working fluid 114, thereby facilitating reducing the peak firing temperature in the combustor 106 and/or reducing the formation of $NO_x$.

With additional reference to FIGS. 2-5, various elements and features of the exemplary EGR mixer 200 are shown in greater detail. In the exemplary embodiment, the EGR mixer 200 includes a housing 202 enclosing an interior 212 and having a first end 204 and a second end 206. The housing 202 extends between the first end 204 and the second end 206 along a longitudinal axis A. The housing 202 is open at the first end 204 and the second end 206. The EGR mixer 200 includes working fluid inlet ducts 208 formed at the first end 204 of the housing 202. The working fluid inlet ducts 208 enable working fluid 164 to flow into the interior 212 of the housing 202. The EGR mixer 200 also includes a filter 210 within the housing 202 near the first end 204 and proximate to the working fluid inlet ducts 208. The filter 210 removes particulates or other impurities (e.g., dust, pollen, smoke, bacteria, and the like) entrained within or mixed with the working fluid 164 entering the housing 202. The filter 210 may be any suitable device utilized to filter the air, including, but not limited to, fiberglass filters, pleated or polyester filters, cellulose paper filters, high-efficiency particulate air (HEPA) filters, and/or any suitable device having any suitable penetrating particle size.

The housing 202 encloses a mixing chamber 214 within the interior 212 downstream from the filter 210. The mixing chamber 214 is defined within housing 202 where the exhaust gases 122 are mixed with the working fluid 164. Positioning the mixing chamber 214 downstream from the filter 210 provides several advantages. For example, the working fluid 164 (e.g., ambient air) flowing into the housing 202 may be at a lower temperature than the exhaust gases 122 which, even after being treated by the exhaust gas treatment system 152, may still be at relatively higher temperature and have a substantial saturation level (e.g., moisture content). After mixing with the cooler working fluid 164, the temperature of the exhaust gases 122 is lowered, and the moisture within the exhaust gases 122 condenses, creating fluid (e.g., water) droplets within the housing 202. The filter 210, which may include filter media susceptible to damage by the fluid droplets, is upstream from any fluid droplets that form as a result of the mixing and, as such, wetting and/or damaging of the filter media due to condensation is reduced or eliminated. Additionally, positioning the filter 210 upstream from the mixing chamber 214 facilitates reducing a pressure drop caused by the EGR mixer 200 in generating the mixture 166 channeled to the compressor 104. Rather, instead of channeling both the working fluid 164 and the recirculated exhaust gases 122 through the filter 210, only the working fluid 164 is passed through the filter 210. Thus, only the working fluid 164 stream experiences a pressure drop caused by the filter 210. Compared to conventional mixers that may inject exhaust gas upstream from a filter house, the EGR mixer 200 that injects the exhaust gases 122 downstream from the filter may facilitate about a 1.7 inch water column reduction in pressure drop across the EGR mixer 200, which is equivalent to about a 3 megawatt (MW) increase in power output from the power generation system 100.

To inject the exhaust gases 122 into the mixing chamber 214, the EGR mixer 200 includes a exhaust gas inlet duct 216 that extends outward from the housing 202 and that fluidly couples the EGR loop 154 (shown in FIG. 1) with the mixing chamber 214. The exhaust gas inlet duct 216 is coupled to the side of the housing 202 adjacent to the mixing chamber 214. A plurality of exhaust gas injection ducts 218 fluidly coupled with the exhaust gas inlet duct 216 extend into and across the mixing chamber 214. The exhaust gas injection ducts 218 each have an open end 220 (also referred to herein as an inlet of the exhaust gas injection duct 218) that faces towards the exhaust gas inlet duct 216, and each open end 220 defines an opening in the housing 202 that enables the exhaust gases 122 to flow into a respective exhaust gas injection duct 218. Moreover, the open ends 220 are substantially flush with, or may extend outwardly beyond, the side of the housing 202 coupled to the exhaust gas inlet duct 216. Furthermore, the open ends 220 are the only openings in the housing 202 adjacent to the mixing chamber 214 so that exhaust gases 122 are required to flow through the exhaust gas injection ducts 218 to enter the mixing chamber 214. Alternatively stated, the exhaust gas injection ducts 218 form the only flow paths for the exhaust gases 122 to enter into the mixing chamber 214 from the exhaust gas inlet duct 216. As such, the ducts 218 facilitate enhancing the control over the direction of the injected exhaust gases 122 in the mixing chamber 214.

In the exemplary embodiment, the exhaust gas injection ducts 218 each extend transversely, relative to the longitudinal axis A, in the mixing chamber 214. Each exhaust gas injection duct 218 includes at least one series of holes 226 extending along the transverse direction of the respective duct 218. An end 222 (shown in FIGS. 6 and 7) of each of the exhaust gas injection ducts 218 opposite the open end 220 may be closed, or may be located outside the mixing chamber 214 opposite the exhaust gas inlet duct 216, so that the holes 226 provide the only egress locations for the exhaust gases 122 to be injected into the mixing chamber 214. In the exemplary embodiment, the exhaust gas injection ducts 218 are arranged in succession, with each extending substantially perpendicular to the longitudinal axis A, and each being substantially parallel to one another. Arranging the exhaust gas injection ducts 218 in substantially parallel succession may facilitate reducing the cross-sectional area of the mixing chamber 214 and, thereby, may facilitate reducing the overall footprint of the EGR mixer 200. In the exemplary embodiment, the exhaust gas injection ducts 218 are oriented horizontally in vertically-stacked succession. In other embodiments, the exhaust gas injection ducts 218 may be oriented in any other orientation that enables the ducts 218 to function as described herein, such as vertically in a horizontally-stacked orientation.

It should be appreciated that the exhaust gas inlet duct 216 may be adjacent to the mixing chamber 214 and coupled to any side of the housing 202, depending on the orientation of the exhaust gas injection ducts 218 and depending on the relative position of the EGR mixer 200 on the EGR loop 154. In the exemplary embodiment, the EGR mixer 200 includes sixteen exhaust gas injection ducts 218 arranged in parallel succession. In other embodiments, any other number of exhaust gas injection ducts 218 may be included that enables the EGR mixer 200 to function as described herein. The number of the exhaust gas injection ducts 218 may vary, for example, based on size and operational requirements of the EGR mixer 200.

A plurality of support beams 224 extend across the mixing chamber 214. The support beams 224 extend substantially perpendicular to the longitudinal axis A and substantially perpendicular to the transverse direction of the exhaust gas injection ducts 218. The support beams 224 are fixedly coupled to each duct 218 and to the housing 202. The support beams 224 maintain the relative position of each of the exhaust gas injection ducts 218 in the mixing chamber 214 during operation. As such, the support beams 224 facilitate preventing dislocation of the ducts 218 via vibrations, mechanical loading, and the like, which may be caused by the flow and mixing of the exhaust gases 122 and working fluid 164 within the mixing chamber 214.

The exhaust gas injection ducts 218 are oriented such that the exhaust gases 122 are injected, via the holes 226 of each duct 218, in cross-flow relative to the working fluid 164 flowing through the EGR mixer 200. The working fluid 164 flows into mixing chamber 214 along a flow direction X that is substantially parallel to the longitudinal axis A, and the mixture 166 exits the EGR mixer 200 via an outlet 228 at the open second end 206 along the flow direction X. The exhaust gases 122 are injected in a direction that intersects the flow direction X (e.g., in a direction perpendicular to the flow direction X or at an oblique angle to the flow direction X) to define the cross-flow relation of the injected exhaust gases 122 relative to the working fluid 164. Thereby, turbulent flow is created within the mixing chamber 214 which induces mixing of the working fluid 164 and the injected exhaust gases 122. The turbulent flow facilitates efficient and substantially uniform mixing of the working fluid 164 and the injected exhaust gases 122 within the mixing chamber 214. In particular, the turbulent flow generated by the cross-flow relation of the injected exhaust gases 122 relative to the working fluid 164 facilitates producing a homogenous distribution of the working fluid 164 and the exhaust gases 122 in the mixture 166 and facilitates uniform thermal mixing to reduce a temperature of the exhaust gases 122 such that the mixture 166 exiting the EGR mixer 200 has a substantially stable temperature. The homogenous distribution of the mixture 166 facilitates efficient operation of the compressor 104 and downstream combustor 106 that utilizes the mixture 166 in operation of the gas turbine engine 102. The reduced temperature of the exhaust gases 122 facilitates substantially generating any condensate that will form as a result of mixing the exhaust gases 122 with the working fluid 164 within the EGR mixer 200. As described in further detail below, the EGR mixer 200 facilitates removing the condensate generated by the mixing prior to the mixture 166 exiting the EGR mixer 200. Thereby, moisture (e.g., water) is substantially eliminated prior to the mixture 166 entering the compressor 104. Moreover, the turbulent flow generated by the cross-flow relation of the injected exhaust gases 122 relative to the working fluid 164 facilitates reducing the pressure of the exhaust gases 122 at the exhaust gas inlet duct 216 required to induce adequate mixing. For example, the EGR mixer 200 may facilitate adequate mixing of exhaust gases 122 at 40% recirculation where the exhaust gases 122 have an inlet pressure of about 20 mbar or lower at the exhaust gas inlet duct 216. It should be appreciated that the inlet pressure required for the exhaust gases 122 may be based on the recirculation percentage utilized. The EGR mixer 200 suitably reduces the inlet pressure required for the exhaust gases 122 to achieve sufficient mixing at various recirculation percentages within an operating range of the EGR system 150, e.g., within a range from between about 0% to about 40% recirculation of the exhaust gases 122. Reducing the inlet pressure of the exhaust gases 122 entering the EGR mixer 200 facilitates reducing energy costs associated with recirculating the exhaust gases 122 (e.g., a lower energy output of the blower 162 is required).

Figure 5:
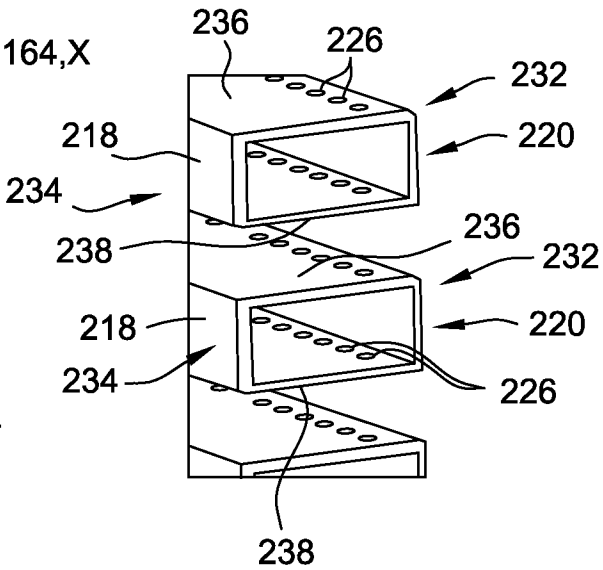
FIG. 5 is an enlarged view of Section Circle C in FIG. 4, showing a portion of exhaust gas injection ducts located within a mixing chamber of the exhaust gas recirculation mixer in greater detail.
Figure 4:
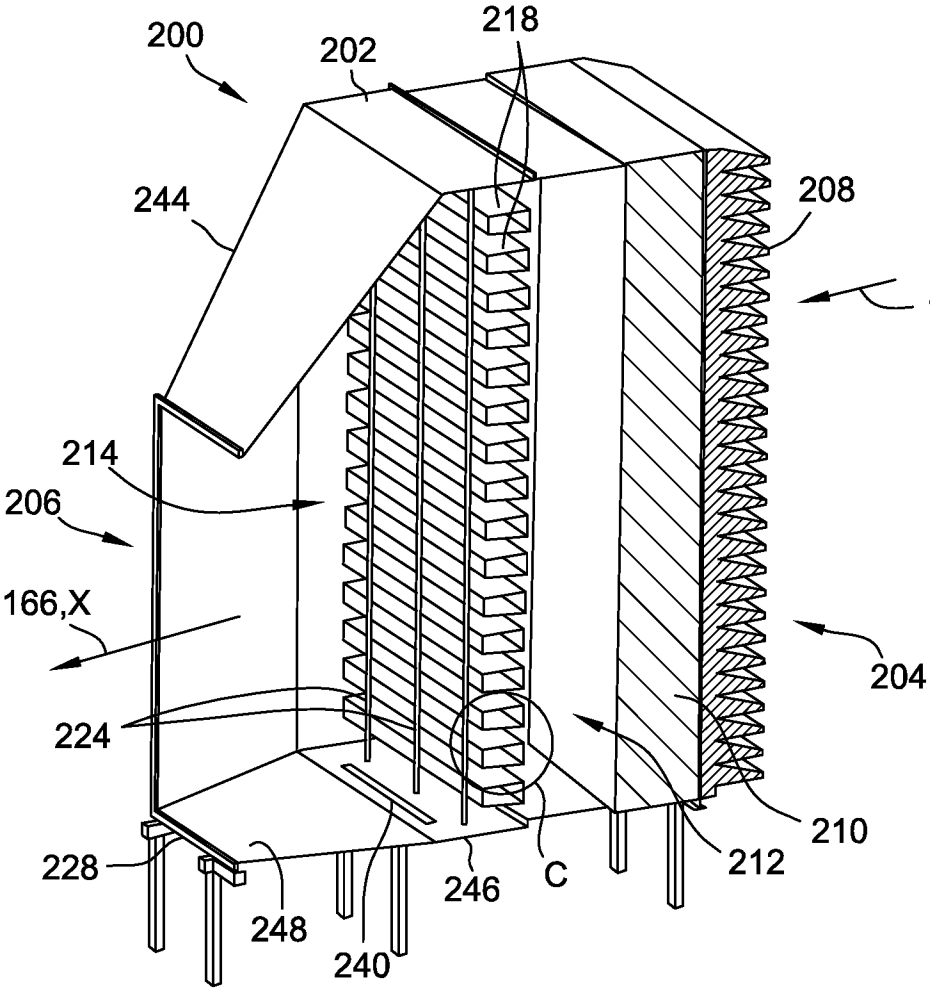
FIG. 4 is another perspective view of the exhaust gas recirculation mixer of FIG. 2, with various portions removed to show an interior of the mixer in greater detail.
Figure 6:
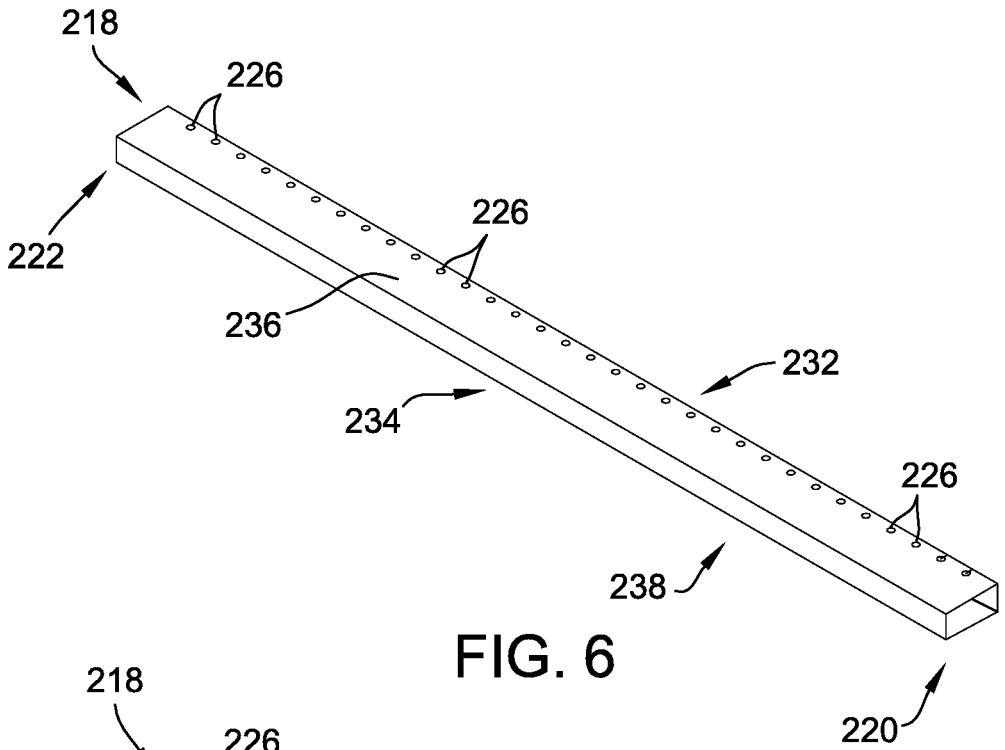
FIGS. 6 and 7 are isolated perspective views of exemplary exhaust gas injection ducts used in the exhaust gas recirculation mixer of FIGS. 2-4 having different distributions of injection holes formed thereon.
Figure 7:
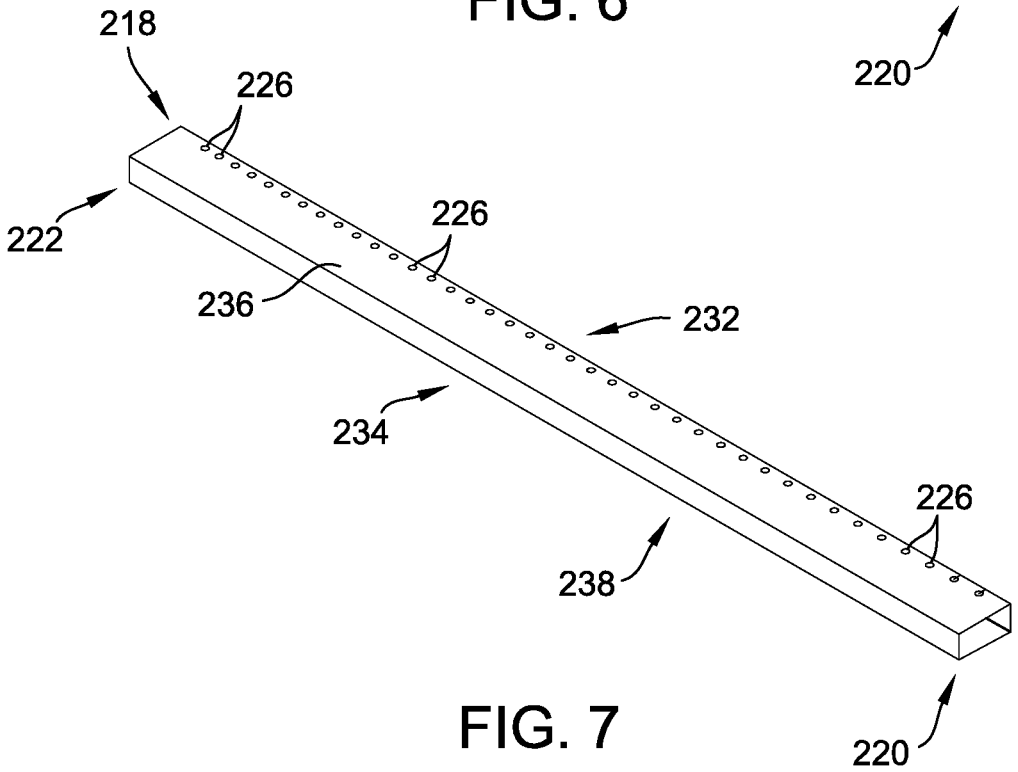

Referring to FIGS. 5-7, the shape, size, position, and/or distribution of the series of holes 226 on each of the exhaust gas injection ducts 218 may be any shape, size, relative position, and/or distribution that enables sufficient mixing between the working fluid 164 and the injected exhaust gases 122. Each of the exhaust gas injection ducts 218 has a leading side 232, a trailing side 234, and opposing exhaust gas injection sides 236 and 238 extending between the leading side 232 and the trailing side 234. When the exhaust gas injection ducts 218 are installed in the EGR mixer 200, the leading side 232 faces towards the first end 204, the trailing side 234 faces towards the second end 206, and the opposing injection sides 236 and 238 extend between the leading side 232 and the trailing side 234 generally along the longitudinal axis A. As such, the opposing injection sides 236 and 238 generally face towards a direction that intersects (e.g., is perpendicular to) the longitudinal axis A when the exhaust gas injection ducts 218 are installed. In the exemplary embodiment, when the ducts 218 are installed in vertically-stacked orientation, the injection side 236 may form a top side of the ducts 218, and the injection side 238 may form a bottom side of the ducts 218. In the exemplary embodiment, the at least one series of holes 226 includes a first series of holes 226 formed on the injection side 236 and a second series of holes 226 formed on the opposing injection side 238. Forming the series of holes 226 on the opposing injection sides 236 and 238 orients the holes 226 when the exhaust gas injection ducts 218 are installed to facilitate injecting the exhaust gases 122 in a direction that intersects the flow direction X (e.g., in a direction perpendicular to the flow direction X or at an oblique angle to the flow direction X). In other embodiments, any other number of series of holes 226 may be formed on the injection sides 236 and 238, for example, two series of holes 226 may be formed on one or each of the injection sides 236 and 238. In some embodiments, a series of holes 226 may be formed on one of the injections sides 236 and 238 and not on the other one of the injection sides 236 and 238. Moreover, in some embodiments, a series of holes 226 may also be formed along the leading side 232 and/or the trailing side 234. The shape of the holes 226 may be, for example, a square shape, a circular shape, an elliptical shape, a triangular shape, another polygonal shape, or any other shape, and the holes 226 may have any suitable size (e.g., diameter or cross-sectional area) that facilitates injecting the exhaust gases 122 at a suitable rate into the mixing chamber 214.

As shown in FIG. 6, in some embodiments, the series of holes 226 formed along each of the exhaust gas injection ducts 218 may be equally distributed along the length of the duct 218 between the open end 220 and the opposing end 222. That is, the series of holes 226 includes pairs of adjacent holes 226, and each pair of adjacent holes 226 is spaced apart a distance equal to a distance between each other pair of adjacent holes 226 of the series of holes 226. In other embodiments, the series of holes 226 may be unequally distributed along the length of the duct 218 between the open end 220 and the opposing end 222. For example, as shown in FIG. 7, adjacent pairs of holes 226 proximate to the opposing end 222 may be spaced apart a smaller distance than adjacent pairs of holes 226 proximate to the open end 220. Varying the spacing of the holes 226 along the extent of the duct 218 may facilitate improving the distribution of the injected exhaust gases 122 across the mixing chamber 214. For example, as the exhaust gases 122 enters the exhaust gas injection ducts 218 at the open end 220, the exhaust gases 122 injected into the mixing chamber 214 may concentrate at areas in the mixing chamber 214 proximate to the open ends 220 as the gas is injected by the leading holes 226 proximate to the open ends 220. Varying the distribution of the holes 226 to have greater spacing proximate to the open end 220, as shown in FIG. 7, may result in a greater quantity of the exhaust gases 122 flowing substantially through the ducts 218 and reaching the holes 226 proximate to the opposing ends 222 of the ducts 218. As a result, improved distribution of the injected exhaust gases 122 within the mixing chamber 214 may be achieved.

It should be understood that the first series of holes 226 on the injection side 236 and the second series of holes 226 formed on the opposing injection side 238 of a given duct 218 are not required to have the same distribution or arrangement of holes 226. Additionally, the first series of holes 226 and the second series of holes 226 may include holes of different sizes, shapes, and/or angular orientations through the respective injection side 236, 238. Moreover, it should be understood that the size, shape, and arrangement of the first and second series of holes 226 in a given duct 218 may be different in one or more aspects from the size, shape, and arrangement of the first and second series of holes 226 in another duct 218 of the EGR mixer 200.

FIGS. 8-12 show various exemplary cross-sections of the exhaust gas injection ducts 218, taken along lines parallel to the longitudinal axis A when the ducts 218 are installed in the EGR mixer 200. The cross-sections shown in FIGS. 8-12 represent non-limiting examples of cross-sectional shapes that the exhaust gas injection ducts 218 may embody. In various embodiments, the exhaust gas injection ducts 218 may have the same or different cross-sectional shape within the same EGR mixer 200. The cross-sectional shape of the exhaust gas injection ducts 218 may be selected to facilitate, for example, reducing costs, improving aerodynamics within the mixing chamber 214, improving flow distribution of the exhaust gases 122 through and injected from the ducts 218, collecting condensate within the ducts 218 and removing the condensate, among other advantages.

Figure 8:
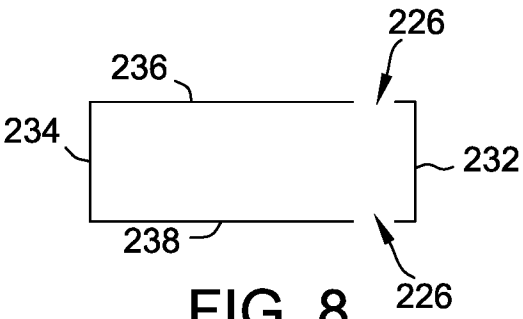

In the exemplary embodiment, and as shown in FIG. 8, the plurality of exhaust gas injection ducts 218 have a rectangular cross-section, and the leading side 232, trailing side 234, and the opposing injection sides 236 and 238 of the ducts 218 are each substantially flat. The holes 226 may be formed in each of the injection sides 236 and 238 proximate to the leading side 232, as shown in FIG. 8, or may be formed in other areas on the sides 236 and 238. In this embodiment, the rectangular cross-section of the ducts 218 may be a lower cost design that is easy to manufacture and/or source.

Figure 9:
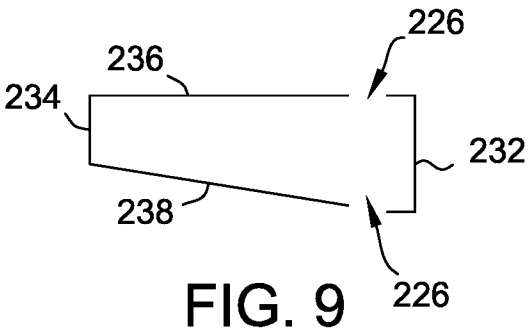
FIGS. 8-12 are various exemplary cross-sections of exhaust gas injection ducts used in the exhaust gas recirculation mixer of FIGS. 2-4.

As shown in FIG. 9, in another embodiment, one or more of the exhaust gas injection ducts 218 may have a similar cross-section as shown in FIG. 8, with the additional feature that the injection side 238 slopes upwardly from the leading side 232 towards the trailing side 234. As discussed above, in the illustrated embodiment, the injection side 238 may form a bottom side of the ducts 218 when installed in the EGR mixer 200. The sloped injection side 238 shown in FIG. 9 may enable condensate collected in the respective exhaust gas injection duct 218 to exit via the series of holes 226 formed in the side 238. It should be appreciated that, in other orientations of the ducts 218, another side that forms the bottom side of the ducts 218 may be sloped as shown in FIG. 9, and holes 226 may be formed in the side that forms the bottom of the ducts 218 to enable condensate to exit.

Figure 11:
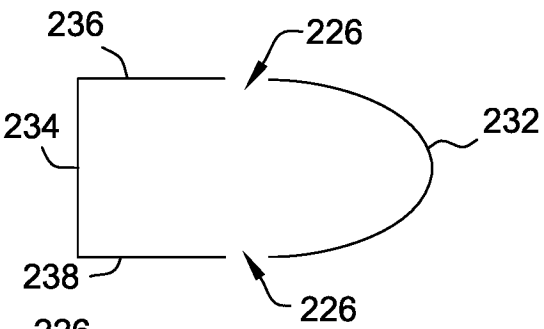
Figure 10:
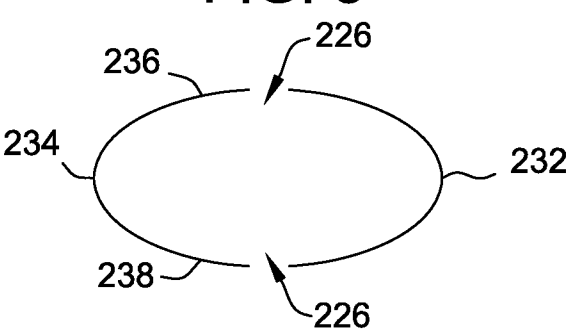
Figure 12:
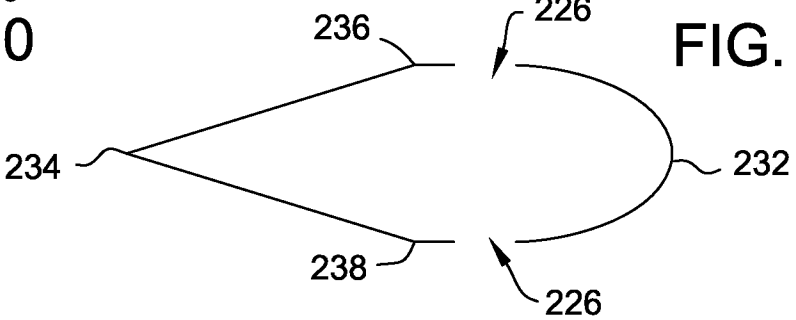

As shown in FIGS. 10-12, in other embodiments, one or more of the exhaust gas injection ducts 218 may have a cross-sectional shape with a curved leading side 232 to facilitate improving aerodynamics within the mixing chamber 214, for example, by enabling the working fluid 164 to flow more easily across the ducts 218. The ducts 218 may, for example, have an oval or circular cross-section (FIG. 10), a bullet-shaped cross-section (FIG. 11), or, as shown in FIG. 12, a hybrid cross-section similar to the bullet-shaped cross-section of FIG. 11 with the injection sides 236 and 238 tapering inwardly in mirrored relationship towards a trailing edge point 234, forming a V-shape of the duct 218 opposite the leading side 232.

Referring again to FIGS. 2-4, the EGR mixer 200 also includes one or more drain ports 240, one or more moisture collectors 242, and a condensate duct 244 that cooperate to extract and remove condensate generated in the mixture 166 before the mixture 166 exits the EGR mixer 200 via the outlet 228. The drain port(s) 240 are suitably formed in a floor 246 the housing 202 below the mixing chamber 214 and/or downstream from the exhaust gas injection ducts 218 (e.g., below the moisture collector(s) 242). The drain port(s) 240 enable condensate that forms within the mixing chamber 214, and within the injection ducts 218, as a result of the higher temperature, saturated exhaust gases 122 thermally mixing with the lower temperature working fluid 164, to flow out from the housing 202.

The moisture collector(s) 242 are positioned within the housing 202 and downstream from the exhaust gas injection ducts 218 and upstream from the outlet 228. The moisture collector(s) 242 extract condensate (e.g., water droplets) from the mixture 166 of the exhaust gases 122 and the working fluid 164 within and/or exiting the mixing chamber 214, before the mixture 166 exits the EGR mixer 200. In particular, the moisture collector(s) 242 include a sheet or a panel of vanes 250, and the mixture 166 flows through the vanes 250 between the mixing chamber 214 and the outlet 228. The vanes 250 may be oriented horizontally or vertically. Each of the vanes 250 is shaped and/or designed (e.g., includes protrusions or other moisture capture features) to create a tortuous flow path the mixture 166 to promote condensation, and the condensate is collected on or is otherwise captured by the vanes 250. As a result, the condensate is separated from the mixture 166. The moisture collector(s) 242 also enable the collected condensate to flow downward toward the floor 246 and exit the housing 202 via the drain port(s) 240. The moisture collector(s) 242 may alternatively be referred to as a drift eliminator, mist eliminator, vane separator, and/or moisture separator.

The condensate duct 244 extends between the mixing chamber 214 and the outlet 228. The condensate duct 244 is shaped to channel condensate from the mixture 166 towards the drain port(s) 240 in the floor 246 of the housing 202. In particular, the condensate duct 244 includes an bottom panel 248 that at least initially slopes upwardly from the floor 246 of the housing 202 toward the outlet 228, and the upwardly sloping portion of the bottom panel 248 channels condensate that is generated in the mixing chamber 214, extracted by the moisture collector(s) 242, and/or otherwise removed from the mixture 166 towards the drain port(s) 240 prior to the mixture 166 exiting the EGR mixer via outlet 228.

During operation, the EGR mixer 200 receives a stream of exhaust gases 122 that are recirculated by the EGR system 150, from the exhaust gas treatment system 152 and/or directly from the gas turbine engine 102, for example, via the exhaust gas inlet duct 216. The EGR mixer also receives the working fluid 164 (e.g., ambient air) via the working fluid inlet ducts 208. The working fluid 164 flows across an interior of the housing 202 of the EGR mixer 200 and into the mixing chamber 214 along the flow direction X. Prior to entering the mixing chamber 214, the working fluid 164 may be flowed across the filter 210 located proximate to the working fluid inlet ducts 208, and the filter 210 removes particulate and other impurities from the working fluid 164. The exhaust gases 122 are injected into the mixing chamber 214 via the plurality of exhaust injection ducts 218 in a direction that intersects flow direction X of the working fluid 164. As a result, turbulent flow is generated within the mixing chamber 214, thus producing the mixture 166 of the working fluid 164 and the exhaust gases 122. During mixing within the mixing chamber 214, condensate may be generated as described above. The condensate may be removed, for example, by the shape of the exhaust gas injection ducts 218 which enable condensate collected in the ducts 218 to flow out therefrom and towards the drain port(s) 240 formed in the floor 246 of the housing 202, by one or more moisture collector(s) 242 that extract condensate from the mixture 166 downstream from the mixing chamber 214 and upstream from the outlet 228 of the EGR mixer 200, and/or by the condensate duct 244 that channels condensate from the mixture 166 towards the drain port(s) 240. The mixture 166 (from which the condensate has been removed) is then directed to the compressor 104 of the gas turbine engine 102 via the outlet 228 of the EGR mixer 200.

Exemplary embodiments of exhaust gas recirculation (EGR) mixers for use in power generation systems that utilize exhaust gas recirculation are described herein. The exemplary EGR mixer embodiments overcome at least some disadvantages over known EGR systems and provide several advantages over conventional designs and processes. The exemplary EGR mixer embodiments facilitate mixing large quantities of exhaust gases and working fluid (e.g., ambient air) supplied to the EGR mixer at low pressures, thus reducing operation costs associated with routing the exhaust gas and/or working fluids (e.g., blower output costs). In particular, the exemplary EGR mixers include an array of exhaust gas injection ducts that inject exhaust gas into the mixer in cross-flow relation relative to the working fluid flowing through the EGR mixer, thus generating turbulent flow and enabling efficient mixing over a reduced cross-sectional area of the mixer. The exemplary EGR mixer embodiments also facilitate reducing the sizing requirements of the EGR mixers, reducing the overall footprint of the EGR system. Moreover, the exemplary EGR mixer embodiments facilitate uniform mixing of the exhaust gas and the working fluid to produce a substantially homogenous and thermally stable mixture, which facilitates reducing or eliminating operational inefficiencies and other undesirable consequences (e.g., compressor distortion and/or surge) otherwise caused by poorly mixed streams. Furthermore, the exemplary EGR mixers are arranged to reduce overall pressure drop of the EGR system, specifically, by injecting exhaust gas to be mixed with working fluid downstream from filter media utilized to filter out particulates from the working fluid. This arrangement also facilitates increasing the useful lifetime of the filter media, which are at substantially lower risk of damage and/or deterioration caused by condensate (e.g., water droplets) formed in the mixture of the exhaust gas and working fluid. The exemplary EGR mixers also include various means of extracting and removing condensate from the mixture of exhaust gas and working fluid, thereby reducing or eliminating the potential of condensate from degrading turbine engine performance or causing other damage downstream from the EGR mixer.

The above description is meant to be exemplary only, and one skilled in the art will recognize that changes may be made to the embodiments described without departing from the scope of the invention disclosed. Modifications, which fall within the scope of the present invention, will be apparent to those skilled in the art, in light of a review of this disclosure, and such modifications are intended to fall within the appended claims. The systems and methods described herein are not limited to the specific embodiments described herein, but rather components of the various systems may be utilized independently and separately from other systems and components described herein. For example, the exhaust gas recirculation mixer can be implemented and utilized in connection with any application where enhanced, uniform mixing and reduced footprint of the mixer are desired.

Although specific features of various embodiments of the invention may be shown in some drawings and not in others, this is for convenience only. Moreover, references to "one embodiment" or "an exemplary embodiment" in the above description are not intended to be interpreted as excluding the existence of additional embodiments that also incorporate the recited features. In accordance with the principles of the invention, any feature of a drawing may be referenced and/or claimed in combination with any feature of any other drawing.

Further aspects of the invention are provided by the subject matter of the following clauses:

1. An exhaust gas recirculation (EGR) mixer for use in a power generation system that includes an EGR system configured to recirculate exhaust gases generated within the power generation system, the EGR mixer comprising: a mixing chamber defining a flow direction; a working fluid inlet coupled with the mixing chamber for introducing a working fluid into the mixing chamber along the flow direction; a plurality of exhaust gas injection ducts extending across the mixing chamber downstream from the working fluid inlet, each of the plurality of exhaust gas injection ducts oriented to receive the exhaust gases being recirculated and to inject the exhaust gases into the mixing chamber in a direction that intersects the flow direction to generate a turbulent flow within the mixing chamber; and an outlet coupled with the mixing chamber downstream from the plurality of exhaust gas injection ducts for directing a mixture of the exhaust gases and the working fluid to a compressor within the power generation system.

2. The EGR mixer in accordance with Clause 1, wherein the plurality of exhaust gas injection ducts is oriented in a parallel succession, each exhaust gas injection duct extending across the mixing chamber in a direction that is substantially perpendicular to the flow direction.

3. The EGR mixer in accordance with any preceding clause, wherein the plurality of exhaust gas injection ducts is oriented in a vertically-stacked succession.

4. The EGR mixer in accordance with any preceding clause, wherein each of the plurality of exhaust gas injection ducts comprises an inlet for receiving the exhaust gases being recirculated and at least one series of holes for injecting the exhaust gases into the mixing chamber.

5. The EGR mixer in accordance with any preceding clause, wherein the at least one series of holes comprises a first series of holes and a second series of holes formed on opposing sides of the respective exhaust gas injection duct, the first series of holes oriented to inject the exhaust gases into the mixing chamber in a first direction that intersects the flow direction, the second series of holes oriented to inject the exhaust gases into the mixing chamber in a second direction that intersects the flow direction.

6. The EGR mixer in accordance with any preceding clause, wherein each pair of adjacent holes of the at least one series of holes is spaced apart a distance equal to a distance between each other pair of adjacent holes.

7. The EGR mixer in accordance with any one of Clauses 1-5, wherein a distance between pairs of adjacent holes of the at least one series of holes varies along a length of the respective exhaust gas injection duct.

8. The EGR mixer in accordance with any preceding clause, further comprising a drain port below the mixing chamber for receiving condensate from the mixture of the exhaust gases and the working fluid.

9. The EGR mixer in accordance with any preceding clause, further comprising a moisture collector downstream from the plurality of exhaust gas injection ducts, the moisture collector being configured to extract condensate from the mixture of the exhaust gases and the working fluid.

10. The EGR mixer in accordance with any preceding clause, further comprising a condensate duct extending between the mixing chamber and the outlet, the condensate duct configured to channel condensate from the mixture of the exhaust gases and the working fluid towards the drain port.

11. The EGR mixer in accordance with any preceding clause, wherein each of the plurality of exhaust gas injection ducts comprises a first series of holes and a second series of holes, each of the plurality of exhaust gas injection ducts being shaped to enable condensate collected in the respective exhaust gas injection duct to exit via the second series of holes.

12. The EGR mixer in accordance with any preceding clause, further comprising a filter proximate to the working fluid inlet and upstream from the plurality of exhaust gas injection ducts for filtering particulate from the working fluid.

13. A power generation system comprising: a rotary machine comprising: a compressor; and a turbine coupled to the compressor and configured to produce exhaust gases; and an exhaust gas recirculation (EGR) system configured to recirculate the exhaust gases from the turbine towards the compressor, the EGR system comprising an EGR mixer for mixing the exhaust gases being recirculated and a working fluid, the EGR mixer comprising: a mixing chamber defining a flow direction; a working fluid inlet coupled with the mixing chamber for introducing the working fluid into the mixing chamber along the flow direction; a plurality of exhaust gas injection ducts extending across the mixing chamber downstream from the working fluid inlet, each of the plurality of exhaust gas injection ducts oriented to receive the exhaust gases being recirculated and to inject the exhaust gases into the mixing chamber in a direction that intersects the flow direction to generate a turbulent flow within the mixing chamber; and an outlet coupled with the mixing chamber downstream from the plurality of exhaust gas injection ducts for directing a mixture of the exhaust gases and the working fluid to the compressor of the rotary machine.

14. The power generation system in accordance with any preceding clause, wherein the rotary machine comprises a gas turbine engine.

15. The power generation system in accordance with any preceding clause, wherein each of the plurality of exhaust gas injection ducts comprises an inlet for receiving the exhaust gases being recirculated and at least one series of holes for injecting the exhaust gases into the mixing chamber.

16. The power generation system in accordance with any preceding clause, wherein the EGR mixer further comprises a filter proximate to the working fluid inlet and upstream from the plurality of exhaust gas injection ducts for filtering particulate from the working fluid.

17. The power generation system in accordance with any preceding clause, wherein the EGR mixer further comprises a moisture collector downstream from the plurality of exhaust gas injection ducts, the moisture collector being configured to extract condensate from the mixture of the exhaust gases and the working fluid.

18. A method of operating a power generation system that includes an exhaust gas recirculation (EGR) system including an EGR mixer, the EGR mixer including a mixing chamber, a working fluid inlet coupled with the mixing chamber, a plurality of exhaust gas injection ducts extending across the mixing chamber downstream from the working fluid inlet, and an outlet coupled with the mixing chamber downstream from the plurality of exhaust gas injection ducts, the method comprising: generating exhaust gases within the power generation system; recirculating at least a portion of the exhaust gases towards a compressor within the power generation system; introducing a working fluid into the mixing chamber of the EGR mixer along a flow direction via the working fluid inlet; injecting the exhaust gases being recirculated into the mixing chamber of the EGR mixer via the plurality of exhaust gas injection ducts in a direction that intersects the working fluid to generate turbulent flow within the mixing chamber and to produce a mixture of the exhaust gases and the working fluid; and directing the mixture to the compressor via the outlet of the EGR mixer.

19. The method in accordance with any preceding clause, further comprising filtering the working fluid prior to introducing the working fluid into the mixing chamber.

20. The method in accordance with any preceding clause, further comprising removing condensate from the mixture of the working fluid and the exhaust gases prior to directing the mixture to the compressor.

While the invention has been described in terms of various specific embodiments, those skilled in the art will recognize that the invention can be practiced with modification within the spirit and scope of the claims.

What is claimed is:

1. An exhaust gas recirculation (EGR) mixer for use in a power generation system that includes an EGR system configured to recirculate exhaust gases generated within the power generation system, the EGR mixer comprising:

a mixing chamber defining a flow direction;

a working fluid inlet coupled with the mixing chamber for introducing a working fluid into the mixing chamber along the flow direction;

a plurality of exhaust gas injection ducts extending across the mixing chamber downstream from the working fluid inlet, each of the plurality of exhaust gas injection ducts oriented to receive the exhaust gases being recirculated and to inject the exhaust gases into the mixing chamber in a direction that intersects the flow direction to generate a turbulent flow within the mixing chamber; and an outlet coupled with the mixing chamber downstream from the plurality of exhaust gas injection ducts for directing a mixture of the exhaust gases and the working fluid to a compressor within the power generation system.

2. The EGR mixer in accordance with claim 1, wherein the plurality of exhaust gas injection ducts is oriented in a parallel succession, each exhaust gas injection duct extending across the mixing chamber in a direction that is substantially perpendicular to the flow direction.

3. The EGR mixer in accordance with claim 2, wherein the plurality of exhaust gas injection ducts is oriented in a vertically-stacked succession.

4. The EGR mixer in accordance with claim 1, wherein each of the plurality of exhaust gas injection ducts comprises an inlet for receiving the exhaust gases being recirculated and at least one series of holes for injecting the exhaust gases into the mixing chamber.

5. The EGR mixer in accordance with claim 4, wherein the at least one series of holes comprises a first series of holes and a second series of holes formed on opposing sides of the respective exhaust gas injection duct, the first series of holes oriented to inject the exhaust gases into the mixing chamber in a first direction that intersects the flow direction, the second series of holes oriented to inject the exhaust gases into the mixing chamber in a second direction that intersects the flow direction.

6. The EGR mixer in accordance with claim 4, wherein each pair of adjacent holes of the at least one series of holes is spaced apart a distance equal to a distance between each other pair of adjacent holes.

7. The EGR mixer in accordance with claim 4, wherein a distance between pairs of adjacent holes of the at least one series of holes varies along a length of the respective exhaust gas injection duct.

8. The EGR mixer in accordance with claim 1, further comprising a drain port below the mixing chamber for receiving condensate from the mixture of the exhaust gases and the working fluid.

9. The EGR mixer in accordance with claim 8, further comprising a moisture collector downstream from the plurality of exhaust gas injection ducts, the moisture collector being configured to extract condensate from the mixture of the exhaust gases and the working fluid.

10. The EGR mixer in accordance with claim 9, further comprising a condensate duct extending between the mixing chamber and the outlet, the condensate duct configured to channel condensate from the mixture of the exhaust gases and the working fluid towards the drain port.

11. The EGR mixer in accordance with claim 8, wherein each of the plurality of exhaust gas injection ducts comprises a first series of holes and a second series of holes, each of the plurality of exhaust gas injection ducts being shaped to enable condensate collected in the respective exhaust gas injection duct to exit via the second series of holes.

12. The EGR mixer in accordance with claim 1, further comprising a filter proximate to the working fluid inlet and upstream from the plurality of exhaust gas injection ducts for filtering particulate from the working fluid.

13. A power generation system comprising:

a rotary machine comprising:

a compressor; and a turbine coupled to the compressor and configured to produce exhaust gases; and an exhaust gas recirculation (EGR) system configured to recirculate the exhaust gases from the turbine towards the compressor, the EGR system comprising an EGR mixer for mixing the exhaust gases being recirculated and a working fluid, the EGR mixer comprising:

a mixing chamber defining a flow direction;

a working fluid inlet coupled with the mixing chamber for introducing the working fluid into the mixing chamber along the flow direction;

a plurality of exhaust gas injection ducts extending across the mixing chamber downstream from the working fluid inlet, each of the plurality of exhaust gas injection ducts oriented to receive the exhaust gases being recirculated and to inject the exhaust gases into the mixing chamber in a direction that intersects the flow direction to generate a turbulent flow within the mixing chamber; and an outlet coupled with the mixing chamber downstream from the plurality of exhaust gas injection ducts for directing a mixture of the exhaust gases and the working fluid to the compressor of the rotary machine.

14. The power generation system in accordance with claim 13, wherein the rotary machine comprises a gas turbine engine.

15. The power generation system in accordance with claim 13, wherein each of the plurality of exhaust gas injection ducts comprises an inlet for receiving the exhaust gases being recirculated and at least one series of holes for injecting the exhaust gases into the mixing chamber.

16. The power generation system in accordance with claim 13, wherein the EGR mixer further comprises a filter proximate to the working fluid inlet and upstream from the plurality of exhaust gas injection ducts for filtering particulate from the working fluid.

17. The power generation system in accordance with claim 13, wherein the EGR mixer further comprises a moisture collector downstream from the plurality of exhaust gas injection ducts, the moisture collector being configured to extract condensate from the mixture of the exhaust gases and the working fluid.

18. A method of operating a power generation system that includes an exhaust gas recirculation (EGR) system including an EGR mixer, the EGR mixer including a mixing chamber, a working fluid inlet coupled with the mixing chamber, a plurality of exhaust gas injection ducts extending across the mixing chamber downstream from the working fluid inlet, and an outlet coupled with the mixing chamber downstream from the plurality of exhaust gas injection ducts, the method comprising:

generating exhaust gases within the power generation system;

recirculating at least a portion of the exhaust gases towards a compressor within the power generation system;

introducing a working fluid into the mixing chamber of the EGR mixer along a flow direction via the working fluid inlet;

injecting the exhaust gases being recirculated into the mixing chamber of the EGR mixer via the plurality of exhaust gas injection ducts in a direction that intersects the working fluid to generate turbulent flow within the mixing chamber and to produce a mixture of the exhaust gases and the working fluid; and directing the mixture to the compressor via the outlet of the EGR mixer.

19. The method in accordance with claim 18, further comprising filtering the working fluid prior to introducing the working fluid into the mixing chamber.

20. The method in accordance with claim 18, further comprising removing condensate from the mixture of the working fluid and the exhaust gases prior to directing the mixture to the compressor.

* * * * *